United States Patent [19]

Matzat et al.

[11] Patent Number: 4,692,255

[45] Date of Patent: Sep. 8, 1987

[54] LUBRICATING GREASE COMPOSITION, ITS PRODUCTION AND USE

[75] Inventors: Norbert Matzat; Hans Schreiber, both of Munich, Fed. Rep. of Germany

[73] Assignee: Optimol-Oelwerke GmbH, Munich, Fed. Rep. of Germany

[21] Appl. No.: 893,534

[22] PCT Filed: Feb. 1, 1984

[86] PCT No.: PCT/DE84/00028

§ 371 Date: Oct. 1, 1984

§ 102(e) Date: Oct. 1, 1984

[87] PCT Pub. No.: WO84/03100

PCT Pub. Date: Aug. 16, 1984

Related U.S. Application Data

[63] Continuation of Ser. No. 668,723, Oct. 1, 1984, abandoned.

[30] Foreign Application Priority Data

Feb. 2, 1983 [DE] Fed. Rep. of Germany ..... 3303442

[51] Int. Cl.[4] ..... C10M 105/56

[52] U.S. Cl. ..... 252/51.5 A

[58] Field of Search ..... 252/51.5 A

[56] References Cited

U.S. PATENT DOCUMENTS

| | | | |
|---|---|---|---|
| 3,015,625 | 1/1962 | Rosscup et al. | 252/51.5 A X |
| 3,242,210 | 3/1966 | Dreher et al. | 252/51.5 A X |
| 3,243,372 | 3/1966 | Dreher et al. | 252/51.5 A |
| 3,401,027 | 9/1968 | Dreher et al. | 252/51.5 A X |
| 3,879,305 | 4/1975 | Ehrlich | 252/51.5 A X |

*Primary Examiner*—Patrick P. Garvin

*Attorney, Agent, or Firm*—Felfe & Lynch

[57] ABSTRACT

A lubricating grease composition of the type wherein mineral or synthetic oil is thickened to the properties of a lubricating grease with a polyurea compound as thickening agent, is provided, along with a method for preparation. The polyurea compound comprises the reaction product of an isocyanate with at least three isocyanate groups in the molecule with a long-chain, straight-chain or branched aliphatic monoamine to give extended temperature and wear properties. The process for the production of this lubricating grease composition involves dissolving the long-chain aliphatic amine or mixture of such amines in the base oil, adding thereto the isocyanate with at least three isocyanate groups, heating the mixture to a temperature of at least 160° to bring about gelling, and mechanically, finely comminuting the gel product.

15 Claims, 5 Drawing Figures

LUBRICATING GREASE COMPOSITION, ITS PRODUCTION AND USE

Figure 1:
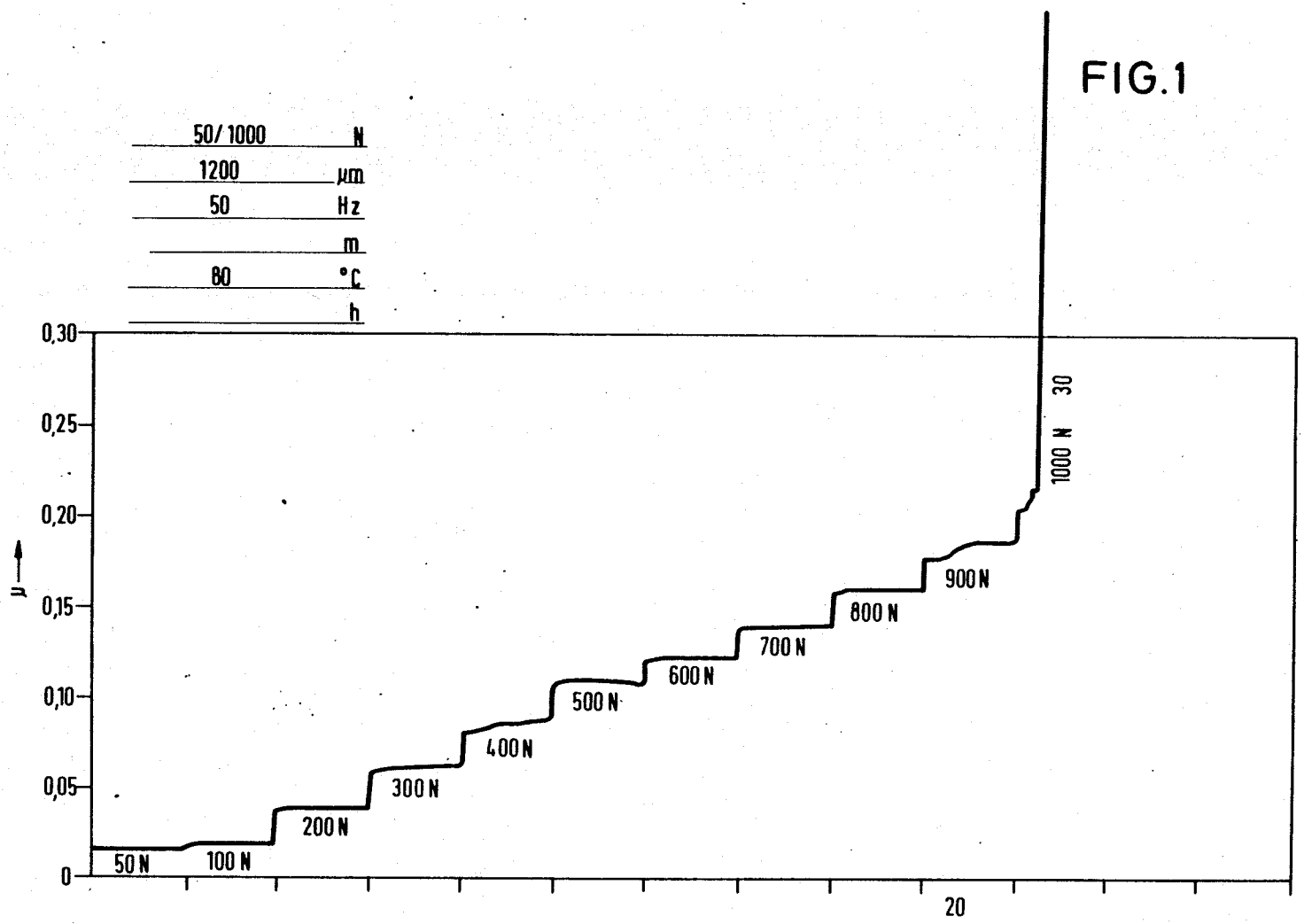
Figure 2:
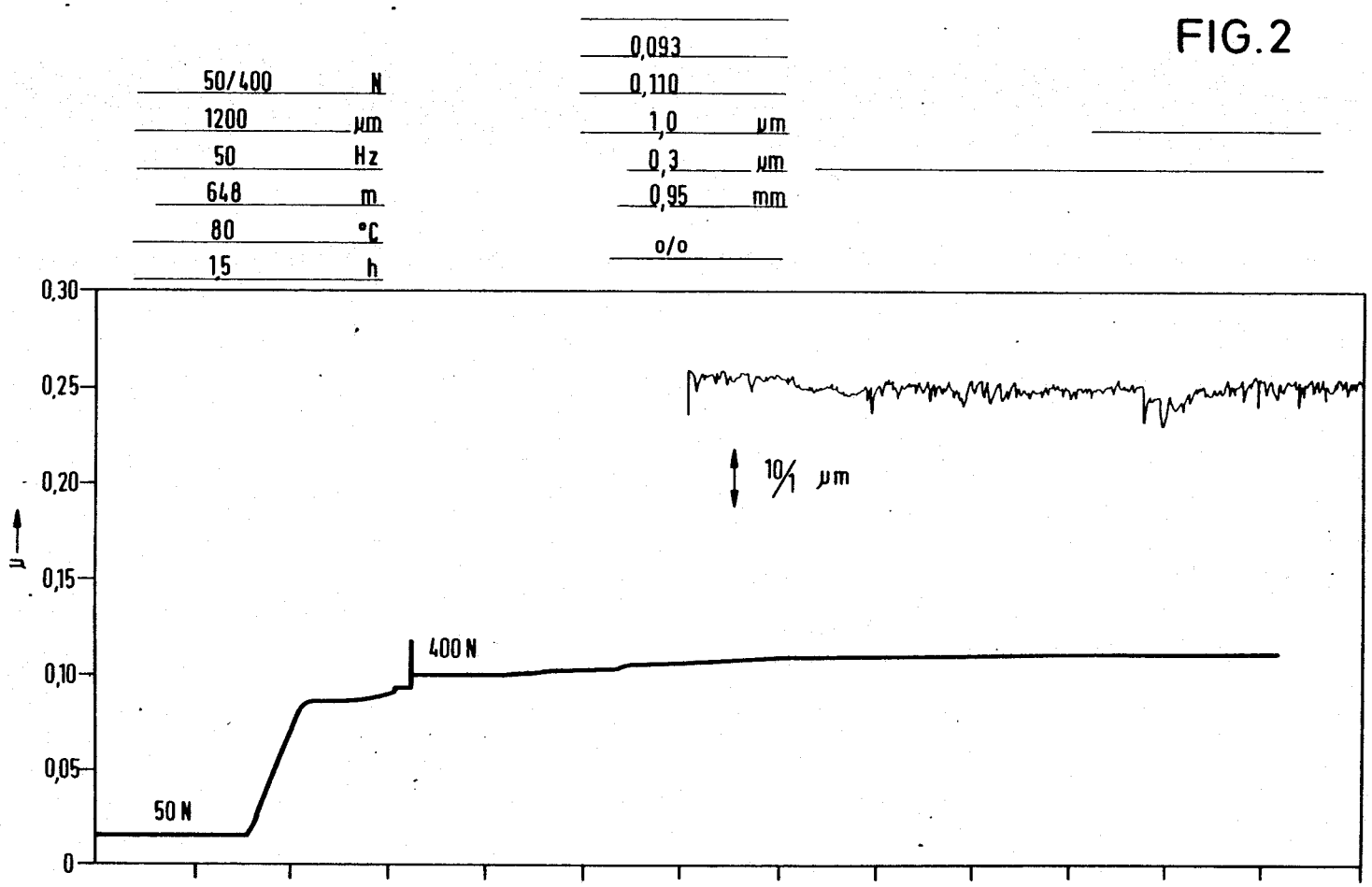

This application is a continuation of application Ser. No. 668,723, filed Oct. 1, 1984, and now abandoned.

The invention concerns a lubricating grease composition based upon a comparatively large proportion of mineral or synthetic oil as base oil and of a smaller proportion of polyurea as thickening agent.

It is known so to thicken lubricating-active mineral or synthetic oils by the addition of polyureas that they achieve the properties of a lubricating grease. The polyureas used in these lubricating greases are produced by the reaction of one or more monoamino- and/or diamino components, which can be aliphatic or aromatic, with diisocyanates, which can also be aliphatic or aromatic. Typical examples herefor are to be found in published Federal Republic of Germany Patent Applications Nos. 25 40 470, 26 04 342 and 26 04 343, as well as in published European Patent Application No. 31 179. The lubricating greases so obtained are adjusted, by the addition of additives, to the specially intended use of the grease, whereby high pressure additives, anti-wear additives and anti-oxidants are usually employed.

These greases have proved to be well suited for many purposes. In particular, they are suitable for comparatively high long-period temperatures of use as the lithium fats, with which admittedly most lubricating problems can be satisfactorily solved but only up to a maximum temperature of use in the region of 135° C. With the polyurea-containing lubricating greases, this temperature limit could be increased into the range of 150° to 160° C.

However, for purposes of use under especially difficult conditions, the previously achieved long-term temperatures of use do not suffice. Therefore, a further increase would be desirable. Furthermore, in many cases, the stability of the polyurea thickening agent in the presence of the necessary additives, especially when it is a question of oil-soluble additives, proves to be unsatisfactory.

The problem forming the basis of the invention is to reduce or overcome these disadvantages of the previously known lubricating grease based on oil with polyureas as thickening agents.

According to the invention, this problem is solved by a lubricating grease composition based on a comparatively large proportion of mineral or synthetic oil as base oil and of a smaller proportion of a polyurea compound as thickening agent, as well as conventional additives, which is characterised in that as polyurea it contains the reaction product of an isocyanate with at least 3 isocyanate groups in the molecule with a long-chained aliphatic monoamine. The polyureas used according to the invention are cross-linked, high molecular products which have been mechanically comminuted. The amine component preferably consists preponderantly of the monoamines with 16 to 24 C-atoms but smaller proportions of monoamines with shorter chains down to 10 C-atoms can also be present, whereby, however, an amount of 10% of the total amine is not to be exceeded. In the same way, small amounts of diamines can be present, whereby an amount of about 5% is not to be exceeded.

By the expression "long-chained aliphatic monoamine" are to be understood compounds with more than 14 C-atoms, preferably those with 16 to 24 C-atoms and mixtures thereof. Longer chained monoamines are admittedly technically also usable for the invention but, at the moment, are economically only difficult to obtain.

The monoamine can be a saturated fatty amine or one containing one or more olefinic double bonds. There come into consideration not only straight-chained, branched but also cyclic aliphatic amines. Especially preferred in the case of singly unsaturated fatty amines are those with 16 to 20 C-atoms, still more preferred an alkenylamine with 18 C-atoms (oleylamine), on the one hand, as well as, in the case of saturated aliphatic alkylamines, those with 18 to 24 C-atoms, still more preferably with 20 to 22 C-atoms, on the other hand. Each of these preferred embodimental forms of the polyurea display special properties with regard to the compatibility with additives.

In this regard, further below it sill be dealt with in more detail.

As isocyanate components with at least 3 isocyanate groups in the molecule, there come into question the commercially available compounds which are known, for example, as Desmodur types of the firm Bayer AG, Hylene types of the firm Du Pont, Mondur types of the firm Mobay Chem. Corp. or Nacconates of the firm Allied Chem. & Dye Corp. Triisocyanates are preferred but tetraisocyanates and still higher polyisocyanates can also be used, expediently in admixture with triisocyanates. In the scope of the invention, in the following they are all referred to as "polyisocyanates". There can be used not only aliphatic polyisocyanates, such as, for example, Desmodur N, which contains tri-, tetra- and higher polyisocyanates, as well as aromatic polyisocyanates, such as for example, Desmodur R. The latter, in the case of which it is chemically a question of p,p',p''-triphenylmethane triisocyanate in the form of a 20% solution in methylene chloride, proves to be especially well suited in the scope of the invention. In addition, the suitability of a special polyisocyanate in the scope of the invention can easily be ascertained by simple preliminary experiments.

The lubricating grease composition according to the invention contains the polyureas in an amount sufficient for the achievement of the desired thickening action. In general, good results are obtained in the case of additions of between 3 and 45 wt.% of polyurea, referred to the base oil. In general, the best results are obtained in the case of amounts between 8 and 15%.

As mentioned, as base oils there come into consideration mineral oil and synthetic oil. Naphthalene-based base oils are preferred. However, paraffin-based base oils can also be used. In the latter case, polyureas are preferably used as thickening agents in the case of which the monoamine component is as long-chained as possible in the scope of the range taught by the invention.

In the case of synthetic base oils, all usual classes prove, in principle, to be suitable even when, with regard to the combination with the polyurea resin, individual members of the groups in question give better results than others. Typical examples of suitable synthetic oils are poly-alpha-olefins, glycols, esters, alkylbenzenes and silicone oils soluble in organic solvents.

The lubricating grease compositions according to the invention can contain not only oil-soluble but also non-oil-soluble additives in order, for example, to improve the high pressure properties, the wear behaviour and the oxidation stability. These lubricant additives are known to the expert and do not here require a detailed explanation, insofar as special aspects in connection with the various possible forms of variation of the polyurea used according to the invention are not to be observed.

As solid additives with high pressure and/or anti-wear improving properties, there come into consideration, in particular, graphite and the lubricating-active metal sulphides alone or in combination with activity strengtheners. Amongst these, graphite and molybdenum disulphide and their mixtures are, in turn, preferred in the scope of the invention. Suitable activity strenghteners are e.g. metal oxides, hydroxides, phosphates or fluorides. These non-oil-soluble additives are especially suitable in combination with polyureas, the monoamine component of which lies in the longer-chained range, thus between about 18 and 24 C-atoms, preferably 20 to 22 C-atoms. However, they can find use in the case of all polyureas to be used in the scope of the invention. The amount of these non-oil-soluble additives lies, in general, between 0.5 and 10 wt.%, referred to the total grease composition, an addition of 2 to 6% being especially preferred. If the stated amounts are exceeded, then one does not obtain any improvement of the properties which would justify the increased costs, in the case of going below the limiting values, the properties aimed for are no longer obtained. Under the aspects of as good a long-lasting strength as possible, friction properties and acceptable price, with 2 to 4% addition of non-oil-soluble additive and usually of oil-soluble anti-oxidant, especially satisfactory results are obtained.

An especial advantage of the lubricating grease composition according to the invention consists, however, in the excellent compatibility with oil-soluble additives, especially also oil-soluble high pressure and anti-wear additives. In the case of previously known lubricating greases with polyurea additives as thickening agents, the highly effective oil-soluble high pressure and anti-wear additives prove to be unsuitable since they led to a rapid breakdown of the polyureas which were produced with diisocyanates. In this regard, permissible oil-soluble additives gave only unsatisfactory properties to the lubricating grease composition. However, in the case of the lubricating grease composition according to the invention, the especially effective oil-soluble additives can also be used without displaying negative actions on the polyurea components in long-term operation. In the case of the oil-soluble additives, the phosphorus- and sulphur-containing compounds are preferred, as well as the replacement products for sulphurised sperm oil which have recently become known. Especially good properties are achieved with the additive combinations known from published Federal Republic of Germany Patent Application No. 1954452.

For these oil-soluble additives, those embodimental forms of the lubricating grease according to the invention have proved to be especially suitable in the case of which the amine component of the polyurea is unsaturated and lies in the lower range of the chain length coming into consideration. In this connection, there is especially preferred an alkenylamine with 18 C-atoms, such as oleylamine.

The oil-soluble additives are, in general, used in amounts between 3 and 20 wt.%, referred to the total lubricating grease composition. An addition between about 5 and 12 wt.% is preferred.

A further subject to the invention is a process for the production of the lubricating grease composition described above in detail. This process is characterised in that one dissolves a long-chained aliphatic monoamine or a mixture of such amines in the base oil, adds polyisocyanate thereto, heats the mixture to a temperature of at least 160° C. until a gelling takes place, mechanically finely comminutes the gelled product and adds thereto the additives and possibly further base oil.

The process starts from the mineral or synthetic oil or mixture of such oils which is to be used as base oil for the lubricating grease composition. If it is a question of a mixture of oils, then the process can also only be carried out with one oil component and the further oil components can first be added later. In the case of the process, it is also possible to start from a smaller proportion of base oil than is needed for the aimed for composition with regard to the amount of polyurea. The amount of oil must merely suffice in order completely to dissolve the amine.

The aliphatic monoamine or mixture thereof is expediently introduced in molten state into the base oil in order to simplify the dissolving, whereby the dissolving can be simplified by stirring and heating. Thereafter or simultaneously, a suitable amount of the selected triisocyanate is added thereto. In general, there are suitable amounts in the case of which ½ to 4 isocyanate groups are available per amine group. However, in special cases, these ratios can be exceeded or gone below.

The mixture obtained is heated until several recognisable reaction steps have been passed through and finally a gelling occurs. The necessary temperature depends upon the reaction components employed and additives possibly present and, as a rule, lies above 160° C., preferably above 200° C. In general, a heating above 240° C. is not necessary but can be used.

The gelled mass is subsequently mechanically comminuted, whereby the known comminution methods and devices can be used. Expediently, the gel is finely ground in a colloid mill. Subsequently, the additives are added, as well as possibly the remaining amount of base oil.

As amine, for the process there is preferred oleylamine or a saturated alkylamine or alkylamine mixture with 20 to 22 C-atoms. With regard to the preferred polyisocyanate, that stated above applies.

The lubricating grease composition according to the invention is characterised by an improved mechanical stability, especially in combination with oil-soluble additives, i.e. oil-soluble high pressure and anti-wear additives. Hitherto, however, satisfactory lubricating greases based on lubricating oil with polyurea as thickening agent with good high pressure properties could only be obtained in the case of the use of non-oil-soluble high pressure additives.

With regard to the achievable high pressure properties and the wear stability, the lubricating grease composition according to the invention is even superior to the best known lithium greases and, at the same time, permits an increase of the long-term use temperature, which in the case of lithium greases lies in the region of 80° to 110° C. and briefly of up to 135° C., to a long-term use temperature of 150° to 160° C., and briefly still further upwards. This accords with a quite substantial improvement of the life and temperature resistance. The lubricating grease composition according to the invention is, however, not inferior to the best commercially available lubricating greases even in the lower temperature range down to considerably below minus 30° C. Thus, it displays a combination of properties which has previously not been known in the case of commercially available products.

For example, with the best known lithium greases, in the case of especially severe conditions, such as are present, for example, in homokinetic flexible couplings and are simulated in drive shaft test benches, 20 to 25 million rollings over at 50° C. can be achieved. With the lubricating grease compositions according to the invention, even at temperatures of 150° to 160° C., at least 30 million rollings over can be achieved.

FIGS. 1–5 show the results produced by using the greases of the invention.

The improved properties achieved according to the invention can be seen from FIG. 1 of the accompanying drawing.

FIG. 1 shows a test sheet which has been obtained with the lubricating grease composition of Example 1 according to the invention on the commercially available lubricating agent test apparatus SRV available from the Applicants, which is described in an "antriebstechnik", 19 (1980), No. 1–2. The lubricating agent composition was, in the case of the given operating conditions, subjected to a loading increasing from 50 to 1000 Newton, without the lubricating effectiveness thereby failing. This means that the flow limit of the metal is reached in the surface roughnesses without the lubricating action of the lubricating grease composition according to the invention being lost.

The following Examples further explain the invention.

EXAMPLE 1

4000 g. of naphthene-based base oil of 100 Centistoke at 40° C., viscosity index about 45, are mixed with 400 g. of saturated monofatty amine with 20 to 22 C-atoms in a molten state and mixed with 1200 g. of a 20% solution of p,p',p''-triphenylmethane triisocyanate in methylene chloride, heated while stirring until the methylene chloride has evaporated and then further heated until 240° C. is reached. As soon as the mixture has gelled, it is cooled, comminuted and finely ground in a colloid mill. One thus obtains a base grease which is to be assigned to the penetration class 3 according to German Industrial Standard 51818.

To the so produced base grease are then added 2.5 wt.% of a mixture of graphite and molybdenum disulphide and 0.5% of a commercially available oil-soluble anti-oxidant.

The so obtained lubricating grease is tested in the SRV apparatus. The results are given in test sheet 7922 accompanying as FIG. 2. One can see that, in the case of a loading of 400 Newton and 80° C., after one and a half hours running period, a friction value between 0.093 and 0.110$\mu$ is achieved. The diameter of the abrasion ball amounts to 0.95 mm. The profile diagram of the surface of the frictional point shows a very good straight-lined course.

Figure 3:
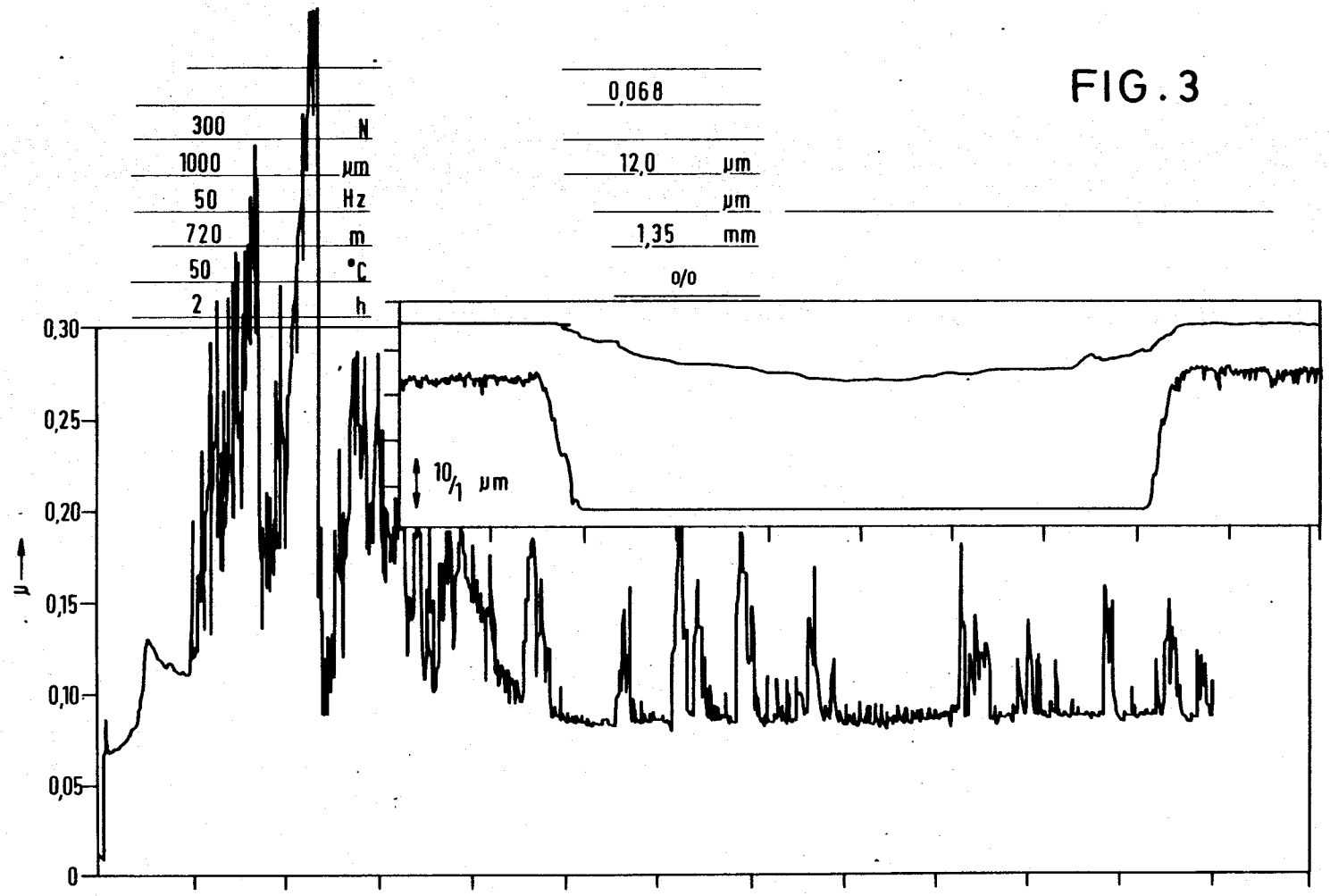

The experiment is repeated with the same base grease but without additives. The SRV test sheet 7650 given in FIG. 3 shows the results. According to this, in the case of a loading of 300 Newton and 50° C., after 2 hours test period the lubricating action has failed and an erosion has occurred. The diameter of the abrasion ball amounted to 1.35 mm., the profile depth on the frictional point 12.0 $\mu$m. in comparison with 1.0 $\mu$m. in the case of the product with additives. The profilogram shows excessive wear up to erosion.

EXAMPLE 2

One proceeded as described in Example 1 but, instead of a saturated monofatty amine with 20 to 22 C-atoms, there was used an equivalent amount of simple unsaturated C18-alkenylamine (oleylamine). As additive, there was added an oil-soluble additive according to published Federal Republic of Germany Patent Application No. 19 54 452, which contained Pb and Mo dialkylthiophosphate, a metal-free sulphur-phosphorus compound and an epoxide of an ester of an unsaturated fatty acid with an alkanol.

Figure 4:
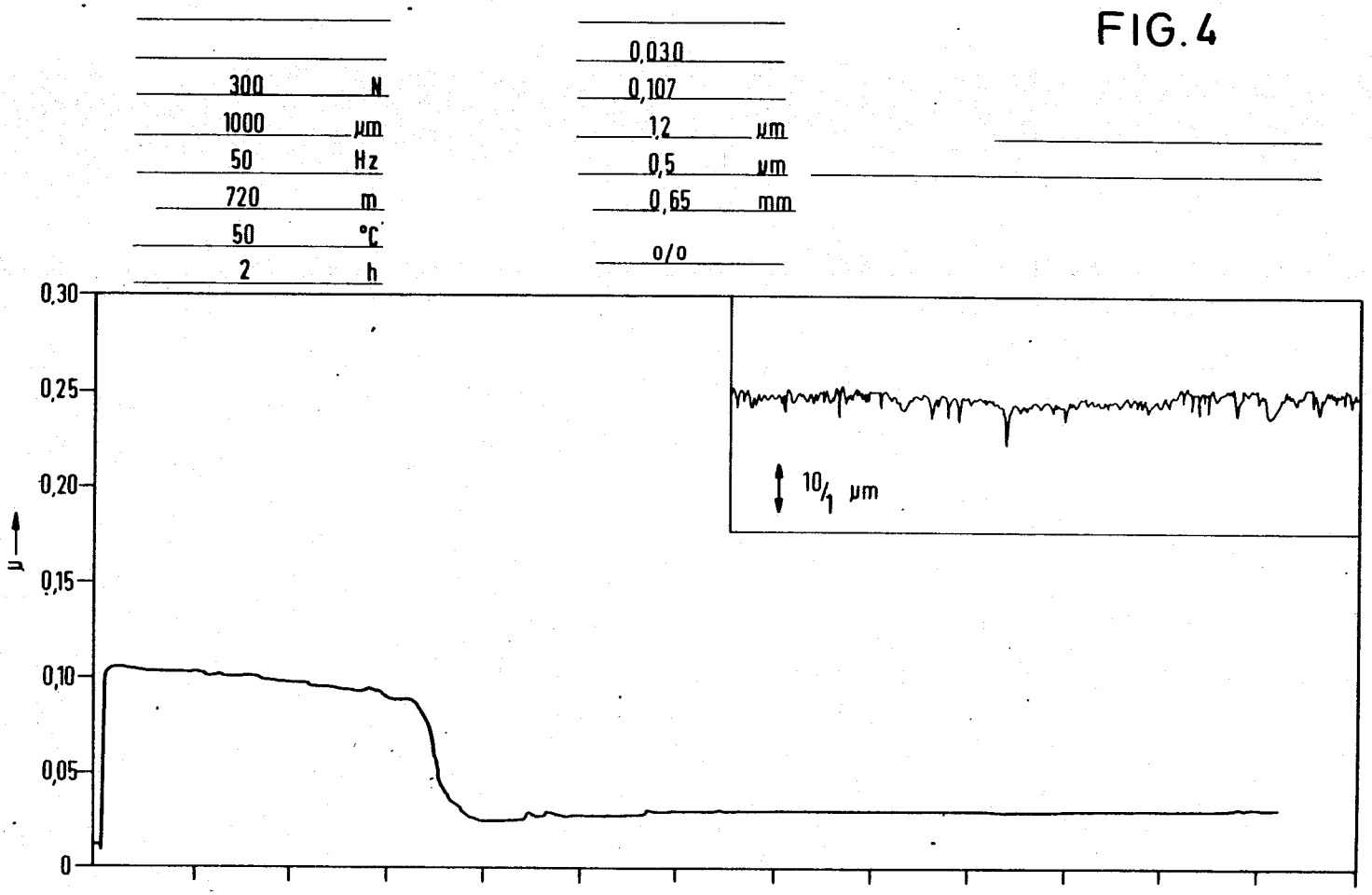

FIG. 4 of the drawing shows the results of the SRV test in the form of the test sheet 8286. One can see therefrom that, in the case of a loading of 300 Newton, there is achieved a friction value of 0.030$\mu$ and the diameter of the abrasion ball only amounted to 0.65 mm. The running in time up to the achievement of the low friction value is short, the profilogram shows a very good course.

EXAMPLE 3

Figure 5:
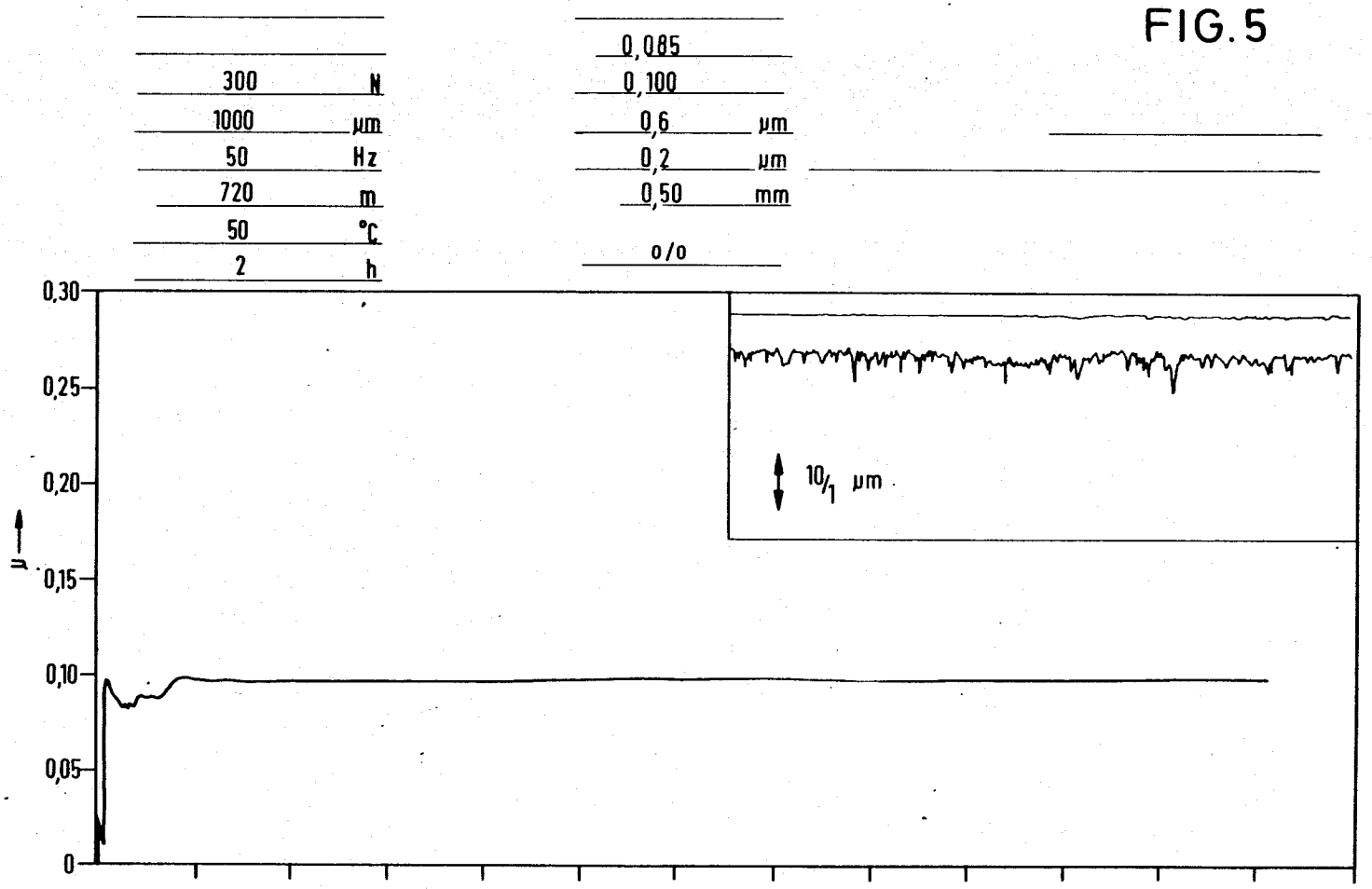

The process of Example 2 is repeated but, instead of the oil-soluble additives, there are used the additives of Example 1 in the there-given amount. The results of the test on the SRV apparatus are shown in FIG. 5 of the drawing in the form of test sheet 8245. The minimal friction value amounts to 0.085$\mu$, the diameter of the abrasion ball to 0.50 mm. at 300 Newton loading.

EXAMPLE 4

A lubricating grease was produced as described in Example 1 but, instead of 800 g. isocyanate solution, there were used 1200 g. the instead of 0.5% anti-oxidant 3%.

The so obtained lubricating grease was investigated on a drive shaft test bench. For this purpose, the coupling was heated to 75° C. surrounding temperature and then loaded at 1200 rotations, 8° bending angle and 320 Nm. In the case of an evaluation scale of 1 to 6, in which 1 represents the best and 6 the worst value, with the best series grease based on lithium soap obtainable commercially there was obtained an evaluation of 4.3±1 and an external temperature of 103±10° C., which corresponds to a coupling internal temperature of 105° to 130° C.

With the grease according to the invention, under the same conditions, there was achieved an evaluation of 3.0±1 and an external temperature of 95±10° C. However, solely due to the temperature reduction, in the case of the lubricating grease according to the invention there can be expected a doubling of the period of life of the coupling quite apart from the fact that the series grease works on the limit of its prolonged temperature stability, whereas the grease according to the invention lies far below such a limiting value and thus offers a large safety reserve.

We claim:

1. In a lubricating grease composition of the type wherein mineral or synthetic oil is thickened to the properties of a lubricating grease with a polyurea compound as thickening agent, the improvement wherein, said polyurea compound comprises the reaction product of an isocyanate with at least 3 isocyanate groups in the molecule with a long-chained straight-chained or branched aliphatic monoamine.

2. The lubricating grease cmposition of claim 1, containing 3 to 45 wt.% of polyurea, referred to the base oil.

3. The lubricating grease composition of claim 1 or 2, wherein the polyurea is based upon triphenylmethane triisocyanate.

4. The lubricating grease composition of claim 1 wherein the polyurea comprises an alkenylamine with 18 C-atoms as amine component.

5. The lubricating grease composition of claim 1 wherein the polyurea comprises a saturated C20 to C22 alkylamine as amine component.

6. The lubricating grease composition of claim 5, further comprising oil-soluble high pressure and/or anti-wear additives.

7. The lubricating grease composition of claim 6, containing 3 to 20 wt.% of said additives.

8. The lubricating grease composition of claim 5, further comprising non-oil-soluble high pressure and/or anti-wear additives.

9. The lubricating grease composition of claim 8, comprising graphite and/or a lubricating-active metal sulphide as said high pressure or anti-wear additive.

10. The lubricating grease composition of claim 9, comprising 0.5 to 10 wt.% of said additives.

11. The lubricating grease composition of claim 1 further comprising 2 to 6 wt.% of non-oil-soluble additives or 3 to 12 wt.% of oil-soluble additives.

12. In a process for the production of a lubricating grease composition of the type comprising mineral or synthetic base oil thickened with polyurea, the steps comprising dissolving a long-chained aliphatic amine or a mixture of such amines in the base oil, adding thereto isocyanate with at least 3 isocyanate groups in the molecule, heating the mixture to a temperature of at least 160° C. to bring about gelling, and mechanically finely comminuting the gelled product.

13. The process of claim 12, wherein ½ to 4 equivalents of isocyanate groups per amine group are added.

14. The process of claim 12, wherein the amine is oleylamine or a saturated alkylamine or alkylamine mixture with 20 to 22 C-atoms.

15. The process of claim 12 wherein the isocyanate is triphenylmethane triisocyanate.

* * * * *